United States Patent [19]

Miller

[11] Patent Number: 4,629,103

[45] Date of Patent: Dec. 16, 1986

[54] SKI BOOT CARRIER

[76] Inventor: Mervin C. Miller, 4204 Standish Ave. South, Minneapolis, Minn. 55407

[21] Appl. No.: 760,098

[22] Filed: Jul. 29, 1985

[51] Int. Cl.[4] ..... A45F 3/14

[52] U.S. Cl. ..... 224/250; 224/257; 224/917

[58] Field of Search ..... 280/809; 294/146, 147, 294/150, 153, 143, 165, 151, 156, 164; 224/202, 917, 218, 191, 205, 257, 250; 211/34

[56] References Cited

U.S. PATENT DOCUMENTS

| | | | |
|---|---|---|---|
| 2,479,187 | 8/1949 | Tomlin | 211/34 X |
| 3,721,373 | 3/1973 | Penniman | 224/257 X |
| 3,794,226 | 2/1974 | Penniman | 294/165 X |
| 4,537,436 | 8/1985 | Pfortmiller | 294/150 |

*Primary Examiner*—Stephen Marcus
*Assistant Examiner*—Robert M. Petrik
*Attorney, Agent, or Firm*—Schroeder & Siegfried

[57] ABSTRACT

A panel in the same general shape as a cross-section of a ski boot is inserted between a pair of side-by-side ski boots and has a first strap substantially parallel with the bottom edge of the boots but encircles the ski boots and extends through front and rear vertically entending slots formed in the panel. A second strap is inserted into a vertically extending slot formed in the panel and a looped strap is extended upwardly above the ski boots while extending downwardly and outwardly from the vertically extending slot and under the soles of the ski boots with the strap extending back over the toes of the ski boots through a forwardly extending toe slot formed in the front of the panel.

5 Claims, 4 Drawing Figures

SKI BOOT CARRIER

BACKGROUND OF THE INVENTION

This invention relates to article carriers and more specifically to ski boot carriers.

Whenever a skier leaves for the skiing area, he generally must tote with him not only his skis, clothing, waxes, and other paraphernalia but generally needs to have at least one hand free for carrying a number of articles. Carrying one's ski boots has always presented a problem because some ski lodges or ski resorts simply do not have adequate facilities for storing such equipment when not in use. The equipment must be adequately stored or contained within the clothing of the wearer to prevent theft of the same as an additional problem.

It has been found that it is desirable to have a means of securing two ski boots together and have some means for carrying them so that they provide the least trouble for their wearer. Additionally, when they are being worn, it is also desirable to have a mechanism that will contain the ski boots but when not in use is readily disposed within the ski clothing so that it does not have to be stored in a locker or within some security area.

FIELD OF THE INVENTION

The present invention is directed to a means of securing two boots into a common package for carrying from one location to another. With a pair of straps, one encircling the upper portion of the ski boots in a manner that is substantially parallel with the bottom edge of the ski boots and the other providing a means of either carrying the ski boots over one's shoulder or carrying them to extend from one's hand, the strap not only passes under the soles of the boots but continues outwardly and up over the toe where the strap passes through a toe loop. The other end of the strap which is in a closed loop is extended through a slot of an inner panel member disposed between the boots such that the weight of the boots keeps the boots drawn together while being transported.

DESCRIPTION OF THE PRIOR ART

The prior art has taken on several shapes and forms, one of which is disclosed in U.S. Pat. No. 3,775,794. This patent discloses a frame mechanism into which ski boots may be inserted and the frame includes a handle member. Even when collapsed, the carrier is a bulky item and is inconvenient to store on the person or to place in a locker if one is available.

U.S. Pat. No. 3,587,951 is directed towards a boot sling that has a loop at each end to engage a pair of boots. However, the loop must be adjusted for different size boots and must be fitted for each of those sizes when in use. There is nothing that draws the two ski boots together when the mechanism is being used.

Another form of ski boot holder is found in U.S. Pat. No. 3,074,085 which is a mechanical shoe tree arrangement to hold the ski boots. This shoe tree needs adjustment even for the heighth of the heel of the boot and is not collapsible nor easily stored.

It is therefore a general object of this invention to provide a ski boot carrier that fits between a pair of side-by-side ski boots.

It is still another object of this invention to provide a ski boot carrier that has a panel for carrying a strap that extends upwardly above the boots and outwardly and under the soles of the ski boots which passes over their toes and through the ski boot panel.

It is still a further object of this invention to provide a pair of straps that work in combination with a ski boot carrier.

It is still another object of this invention to provide a panel for a ski boot carrier that has a general shape of that formed in the same general cross-section of a ski boot.

It is yet another object of this invention to provide a panel for a ski boot carrier that is formed to have the toe area extended forwardly and carry a strap with it.

These and other objects and advantages of the invention will more fully appear from the following description, made in connection with the accompanying drawings, wherein like reference characters refer to the same or similar parts throughout the several views, and in which.

DETAILED DESCRIPTION OF THE DRAWINGS

Figure 1:
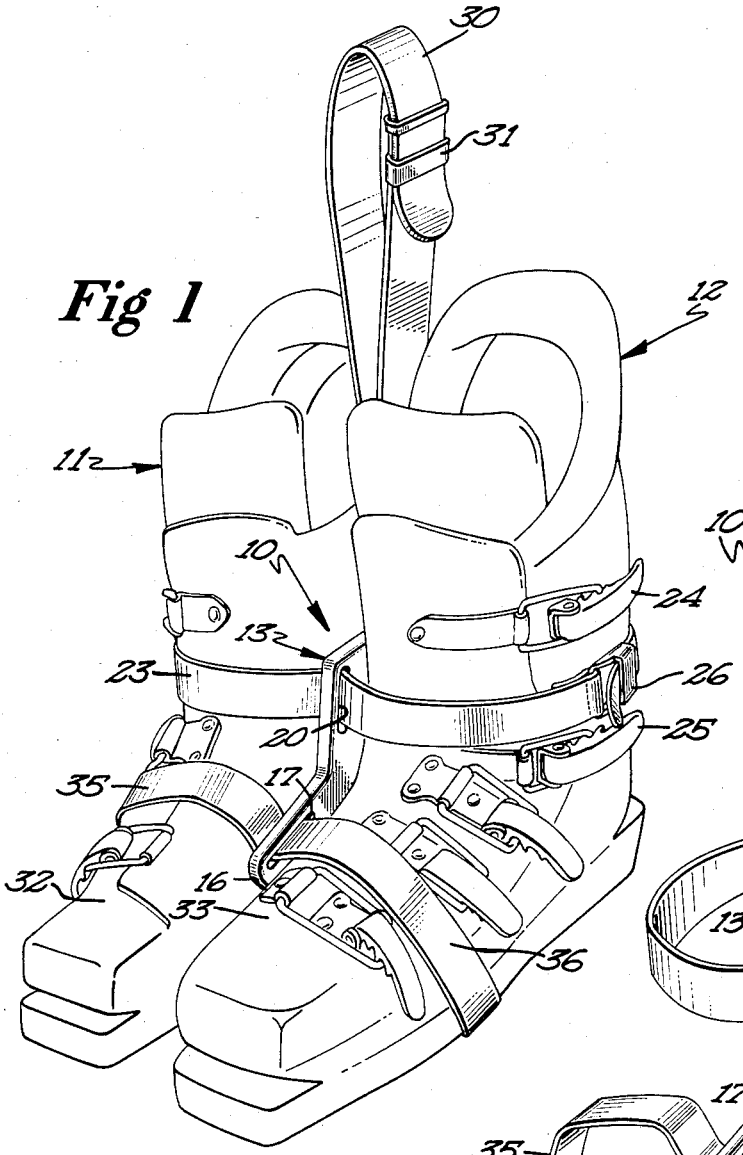
FIG. 1 is a perspective view of the ski boot carrier in use with a pair of side-by-side ski boots.
Figure 4:
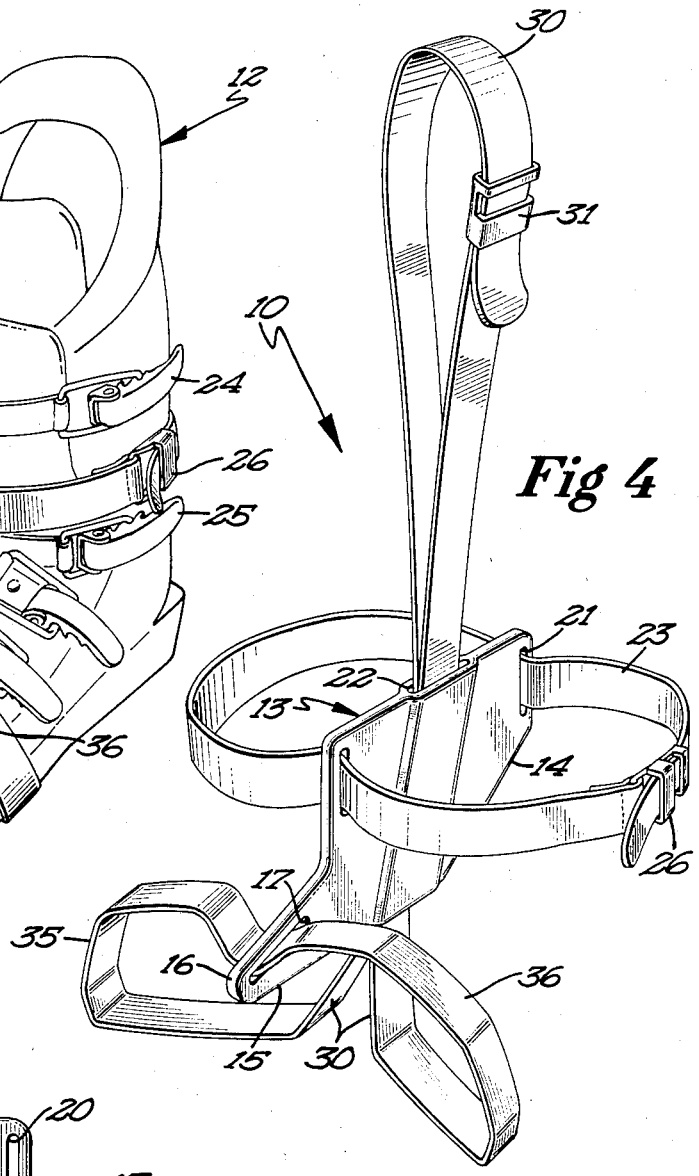
FIG. 4 is a perspective view of the ski boot carrier without the ski boots.
Figure 3:
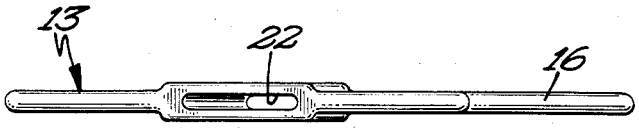
FIG. 3 is a top plan view of the panel used with a pair of ski boots and confining straps.
Figure 2:
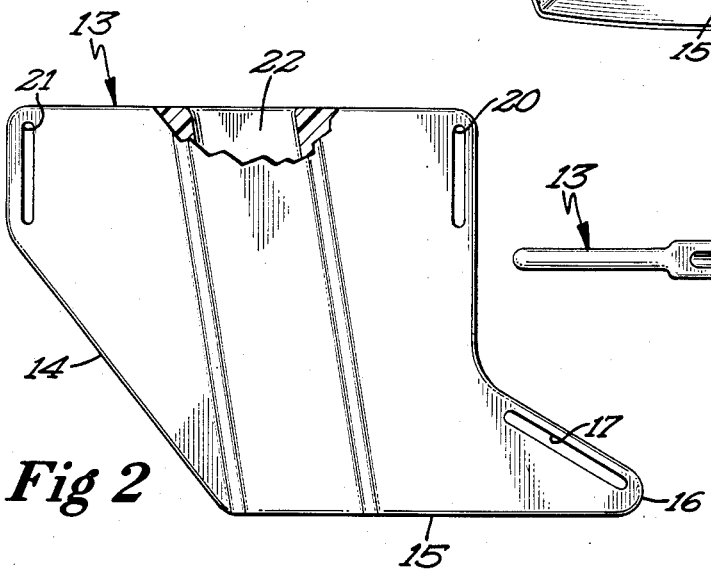
FIG. 2 is a side elevation of a panel inserted between a pair of side-by-side ski boots.

A ski boot carrier 10 is disposed between a pair of ski boots 11 and 12 in which the rear portion of a panel 13 is cut away at the back portion 14. That is, panel 13 may be formed from a form of plastic material or may be made by sandwiching several layers of material together where the general thickness of panel 13 is approximately ¼ of an inch. Panel 13 may be thought of as a substantially square element with the rear portion 14 being removed at an angle of approximately 50° with a bottom edge 15. The lower front portion of the square-like panel 13 is extended into a toe portion 16. Formed in the toe portion 16, is a slot 17 that is oriented at an angle of approximately 30° with respect to bottom edge 15. At the front of panel 13 at its uppermost position, another slot 20 is formed and disposed to the rear, another slot 21 is formed. That is, slot 17, 20, and 21 are all formed transversely through panel 13. The cut-away portion that extends beyond edge 14 accommodates the heels of the ski boots where they generally touch at the rear inside portions.

A generally verticle slot 22 is formed in panel 13 and extends generally from the top to the bottom of panel 13. That is, slot 22 is formed down the center portion of panel 13 at an angle of 80° with bottom edge 15.

Referring specifically to FIG. 1, a strap 23 is fitted about ski boots 11 and 12 and is fitted between a pair of buckles 24 and 25 as found specifically on boot 12 where strap 23 passes through slots 20 and 21 of panel 13. Strap 23 has a buckle 26 secured at its end through which the other end of strap 23 is drawn to keep the boots drawn into a tight configuration with each other.

Another elongated strap 30 is passed through slot 22 and has a buckle 31 formed on one end thereof with the other end of strap 30 extending through the buckle. This portion of strap 30 extends above the tops of boots 11 and 12. Where strap 30 in its double form extends through slot 22 at the bottom thereof, strap 30 is folded under the insole of boot 12 and the other portion of strap 30 extends outwardly under the sole of boot 11 where they both pass over the toe portions 32 and 33 respectively of boots 11 and 12 and pass through slot 17 formed in the toe portion 16 of panel 13.

Thus, when strap 30 is lifted, the inertia toe loops 35 and 36 are not encumbered by any of the buckles or appertainances to the ski boots and thus are drawn tightly to pull the two boots together and into a tight configuration with each other where the two straps 30 pass under the soles. With strap 23 being drawn tightly, the boots are in one secure package. Adjustment of strap 30 to give a longer loop at the top thereof will permit the person to carry the boots over their shoulder. Thus, it is the very weight of the boots 11 and 12 that cause the webbing or strap 30 to tighten the grasp of the boots. Most any ski boot buckle combination will not interfere with the structure as set forth herein.

It will, of course, be understood that various changes may be made in the form, details, arrangement and proportions of the parts without departing from the scope of the invention which consists of the matter shown and described herein and set forth in the appended claims.

What is claimed is:

1. An article carrier comprising:

(a) an elongated strap having a releasable buckle at one end thereof with the other end passing through said buckle;

(b) a panel of generally rectangular shape including a toe portion extending from a side of the panel, the toe portion defining a forward portion of the panel having a thickness at least greater than said strap in cross-section, said panel having a pair of slots formed at the front and rear thereof, and a forwardly extending toe slot formed in the forward area of said panel, all of said slots extending transversely through said panel and having a substantially vertical slot extending from the top to bottom of said panel with a thickness to accommodate at least two thicknesses of said strap; and (c) said strap being formed in a loop with two thicknesses extending upwardly through said substantially vertical slot and carrying said releasable buckle above said vertical slot, said two thicknesses extending downwardly from said vertical slot and first extending divergently outwardly and secondly curving back towards, and joining each other, while passing through said forwardly extending toe slot.

2. The structure set forth in claim 1 including:

(d) a second elongated strap constructed and arranged to cooperate with said first mentioned strap in a substantially loop shaped configuration that extends through said slots formed at the front and rear of said panel whereby an article may be clasped.

3. A ski boot carrier in combination comprising:

(a) a first elongated strap having a releasable buckle at one end thereof with the other end passing through said buckle;

(b) a panel of generally rectangular shape including a toe portion extending from a side of the panel, the toe portion defining a forward portion of the panel greater than said strap in cross-section, said panel having a pair of upwardly extending slots formed at the front and rear thereof, and a forwardly extending toe slot formed in the forward area of said panel, all of said slots extending transversely through said panel and having a substantially vertical slot extending from the top to bottom of said panel with a thickness to accommodate at least two thicknesses of said strap, said panel being disposed between a pair of side-by-side ski boots;

(c) said first strap being formed in a loop with two thicknesses extending upwardly through said substantially vertical slot, carrying said releasable buckle above the upper parts of the ski boots, said two thicknesses extending downwardly from said vertical slot and first extending divergently outwardly under the ski boots and secondly curving back over the toes of the ski boots and joining each other while passing through said forwardly extending toe slot; and (d) a second elongated strap constructed and arranged to cooperate with said first strap in a substantial loop shaped configuration that extends around the upper part of the ski boots and through said slots formed at the front and rear of said panel whereby the ski boots may be clasped.

4. The structure set forth in claims 1 or 3 wherein said panel has the end opposite said forward areas of said panel cut away to expose that portion of said panel.

5. The structure set forth in claims 1 or 3 wherein said substantially vertical slot is disposed at an angle of substantially 80 degrees with the flat bottom edge of said panel.

* * * * *